United States Patent [19]

Cantrell et al.

[11] 4,014,566

[45] Mar. 29, 1977

[54] POCKET-SIZED CHECKBOOK

[76] Inventors: Sally H. Cantrell; Bob I. Cantrell, both of P.O. Box 724, Newport, Oreg. 97365

[22] Filed: Mar. 1, 1976

[21] Appl. No.: 662,965

Related U.S. Application Data

[63] Continuation-in-part of Ser. No. 520,661, Nov. 4, 1974, abandoned.

[52] U.S. Cl. ..... 282/8 R; 282/1 A; 282/3 R; 282/23 R; 281/19 R; 283/58

[51] Int. Cl.[2] ..... B41L 1/20

[58] Field of Search ..... 282/22 R, 23 R, 23 A, 282/8 R, 24 R, 8 A, 8 B, 8 C, 9 R, 10, 11, 1 A, 3 R, 29 R, 29 A, 29 B; 283/58; 281/19 R, 34

[56] References Cited

UNITED STATES PATENTS

| | | | |
|---|---|---|---|
| 1,029,280 | 6/1912 | Davidson | 281/34 |
| 1,382,167 | 6/1921 | Bock | 281/19 R |
| 2,470,586 | 5/1949 | Tathwell | 282/9 R |
| 3,236,542 | 2/1966 | Russell | 282/29 B |
| 3,333,869 | 8/1967 | Alexander | 282/24 R |

*Primary Examiner*—Jerome Schnall
*Attorney, Agent, or Firm*—Chernoff & Vilhauer

[57] ABSTRACT

A pocket-sized checkbook adapted to a register-type checkbook cover for simultaneously recording a checking transaction automatically while a check is being written. A plurality of vertically-offset, overlapping checks are removably attached to a checkbook having a back flap adapted for insertion into a pocket of a register-type checkbook cover. A record sheet is also removably attached to the checkbook for insertion beneath the particular check being written and on top of the remaining unused checks. The record sheet has vertically arranged spaces disposed beneath and corresponding to selected spaces on the face of the checks for duplicating certain information written thereon and computing a balance. A pressure sensitive medium associated with the checks and record sheet transfers the information written on the check to the record sheet, while a separate memo portion of the record sheet may be provided for recording additional information.

3 Claims, 4 Drawing Figures

POCKET-SIZED CHECKBOOK

CROSS-REFERENCE TO OTHER APPLICATION

This application is a continuation-in-part of our copending application, Ser. No. 520,661, filed Nov. 4, 1974, now abandoned.

BACKGROUND OF THE INVENTION

This invention relates to a pocket-sized checkbook which simultaneously records a checking transaction while a check is written.

In the banking industry two commonly used means for carrying checks in pocket-sized form are a register-type checkbook and a stub-type checkbook. A register-type checkbook ordinarily comprises a cover having two pockets, a set of checks having a back flap for insertion into one such pocket, and a separate check register in which a number of checks may be recorded having a flap for insertion to the other pocket. In contrast, a stub-type checkbook usually comprises simply a cover and a set of checks which are tightly held in the cover by a spring clip, each check having a stub attached to the end thereof for recording a single transaction.

When writing a check, in a supermarket for example, it is frequently physically inconvenient and inordinately time consuming subsequently to record the transaction on a stub or separate check register. As a result, checking transactions are sometimes recorded incorrectly or not recorded and later forgotten, which leads to accounting inconsistencies. In any case, it would be beneficial to have a portable, pocket-sized checkbook wherein the checking transaction is automatically recorded at the same time that the check is written so that such inconvenience is eliminated and checking errors are minimized.

Pocket-sized checkbooks previously have been designed for simultaneously recording a checking transaction while writing a check. For example, Moss U.S. Pat. No. 3,254,906 discloses a checkbook wherein a record sheet is provided with vertically arranged spaces for recording successive checking transactions and a plurality of checks are disposed in front of the record sheet with a carbon sheet sandwiched in between. Each successive check includes a horizontal line of spaces or boxes of identifying information lower than its predecessor check so that, as the checks are written, certain identification information is duplicated in successively lower spaces on the record sheet. While this checkbook performs the function of automatically recording a checking transaction, it presents a drawback in that several different types of checks must be printed, each having its identification line in a different vertical position. Moreover, the user is faced with the inconvenience of having to fill in differently positioned spaces for each successive check which he writes. Also, intensity of the record for each successive check will be greater so as to make it difficult for the user to know how hard to write in order to be certain that all transactions are visibly recorded.

Several other types of checkbooks which have been designed for simultaneous recording of a checking transaction while a check is written, such as those disclosed in the Donovan U.S. Pat. Nos. 3,620,553 and 3,734,543, provide separate record sheets for each check; but such arrangements are inconvenient since they require storage of a large number of record sheets and reference to separate record sheets in order to determine how much money has been spent or to compute a balance or the like. A number of accounting systems have also been devised for simultaneously filling in checks or other documents while making a permanent record in which the documents are vertically offset from one another; however, none of these has been devised which is for use as a pocket-sized checkbook.

SUMMARY OF THE PRESENT INVENTION

The present invention overcomes prior art drawbacks by providing a pocket-sized checkbook which utilizes a plurality of vertically offset, substantially identical checks independently attached at a common binding edge and placed in front of a single record sheet upon which checking transaction identification information such as the check number, date, payee and amount is reproduced automatically in response to the writing of a check. Each successive check is vertically offset from its predecessor a distance equal to the amount of space required for writing the desired identification information and computing a balance on the record sheet, so that earlier checks overlap later checks and no identifying information recorded on the record sheet from one check will overlap the identifying or subsequent balance information of another. The record sheet includes vertically arranged spaces corresponding to the information spaces on the faces of the respective checks so that the information from each successive checking transaction will be recorded in a successively lower space. The spaces on the record sheet each include one line for each check for duplicating the amount of that check as well as other information and a second line provided immediately below the amount line for computing a balance and duplicating additional information about the check. In this manner the invention provides the advantage of a single sheet record which can be used to identifying a number of successively written checks at once.

In order to insure that each check is recorded with the same intensity, to avoid the recording of extraneous information on unused parts of the record sheet without having to write part of the check after it is torn off, and to permit the use of a pressure sensitive backing material on the checks for reproducing the transaction information if desired, the record sheet is designed to slip behind the check being written and in front of the next unused check. The record sheet should be made of relatively thick material, in comparison to the checks themselves, so that the information being written on the top check will not be transmitted through the record sheet to the underlying checks. An intermediate flap, which is disposed behind the plurality of checks and bound to the checkbook at the same binding edge as the checks, has the record sheet attached to its opposite edge by a binding which permits the sheet to be removed and permanently stored when filled.

A back flap may be attached at the binding edge common to the checks for inserting the checkbook into a pocket of a register-type checkbook cover or, alternatively, other means such as a clip for holding the binding edge to the cover may be employed. In addition, appropriate creases may be provided in the intermediate flap and record sheet so that the checkbook can fold in half when the cover is closed.

A particularly suitable register-type checkbook cover is provided whereby a pocket is formed therein having an opening adjacent one outside edge of the cover for insertion of the back flap of the checkbook. This arrangement enables the pocket for receiving the back flap to be no greater in size than one-half the checkbook cover, leaving the other half of the cover free for attachment of a set of checking-account deposit slips.

It is therefore a principal object of the present invention to provide a new and improved pocket-sized checkbook for simultaneously recording a checking transaction during the writing of a check.

It is another object of the present invention to provide such a checkbook which records a plurality of checking transactions in vertical sequence on a single record sheet which may thereafter be removed for permanent storage.

It is a further object of the present invention to provide such a checkbook which is suitable for use with a register-type checkbook cover.

The foregoing and other objectives, features, and advantages of the invention will be more readily understood upon consideration of the following detailed description of the invention taken in conjunction with the accompanying drawings.

DESCRIPTION OF THE PREFERRED EMBODIMENT

Figure 1:
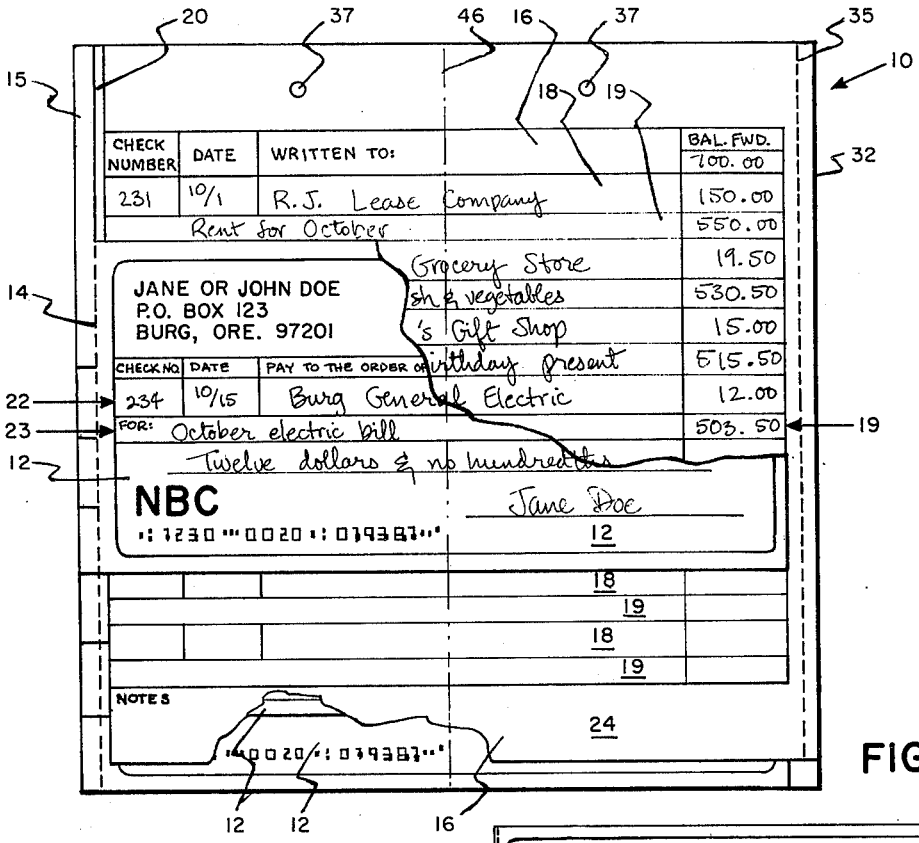
FIG. 1 is a front view of an exemplary embodiment of the checkbook of the present invention with several checks removed and part of the uppermost and lowermost checks cut away.
Figure 3:
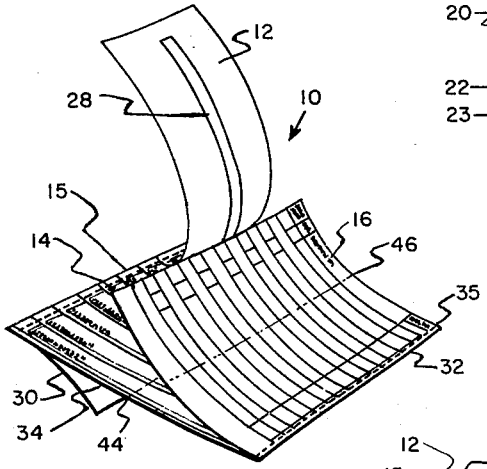
FIG. 3 is a perspective view of the checkbook of the present invention.

Referring particularly to FIG. 1, the checkbook 10 provides a plurality of vertically-offset, overlapping checks 12 independently attached by a hinged principal binding 14 at the left-hand edge 15 of the checkbook. A record sheet 16 is hingedly attached on the right-hand side of the checkbook in a manner to be described more fully hereafter. To summarize the operation of the checkbook, each check 12 is written with the record sheet 16 placed behind it so that the transaction-identifying information on the face of the check is reproduced on the face of the underlying record sheet 16. The check is then removed by tearing it from the principal binding 14, thereby exposing the record sheet. In preparation for writing another check the record sheet is placed beneath the next lower remaining check and on top of the following checks, as shown in FIG. 3, and so on until all of the checks in the checkbook are exhausted. In this manner each consecutive checking transaction is duplicated and recorded in a pair of respectively lower spaces 18 and 19 on the face of a single record sheet 16. When the checks are exhausted the record sheet 16 may be removed and placed in a permanent record book or storage file.

Figure 2:
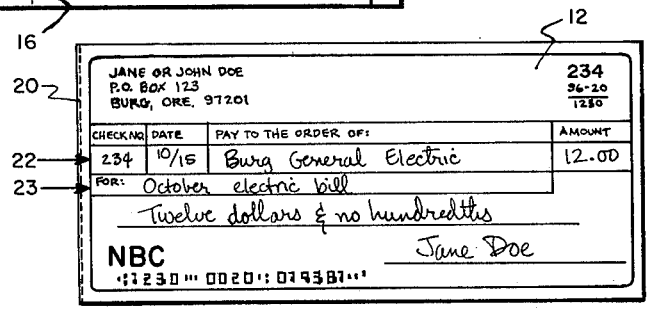
FIG. 2 is a front view of an exemplary check for use with the checkbook of the present invention.

Turning now to the exemplary structure of the checkbook 10, as shown in FIG. 1, while in the present embodiment each check 12 is attached to the principal binding 14 at the left-hand edge 15 of the checkbook 10, it is recognized that the reverse arrangement might be used whereby the principal binding 14 would be disposed at the right-hand edge of the checkbook with the record sheet 16 hingedly attached on the left-hand side. Alternatively it is conceivable that the record sheet could be attached at the top or bottom of the checkbook with either left or right-hand mounted checks. Preferably the principal binding 14 includes a perforation line 20 so that the checks 12 may be easily removed. However, it is also recognized that numerous kinds of bindings which would permit easy removal of the checks might be used. With referenced to FIG. 2, the exemplary check 12 includes a set of selected spaces or blocks 22 for entering the check number, the date, the payee and the amount of the check, all of which is considered to be information which would ordinarily be recorded in a checkbook record. Of course, the check number could be pre-printed on both the check and record sheet. Each space or block of the set 22 is placed on the same horizontal line so that the associated information will be reproduced on a single horizontal line in a corresponding set of spaces 18 on the face of the record sheet 16. In addition a selected space 23 should preferably be provided on a horizontal line immediately below the spaces 22 for recording the purpose of the transaction, which also will be reproduced in a corresponding part of a set of spaces 19 on the face of the record sheet. However, the space 23 should not extend beneath the position in spaces 22 provided for entry of the check amount, since the principal purpose for including the set of spaces 19 on the record sheet is to permit computation of an amount balance immediately below each check entry. It is particularly noteworthy that the spaces or blocks 22 need not be positioned at the tops of the respective checks as is required by some vertically offset check systems, but are preferably located below the top edge of the next lower check. Accordingly various arrangements of information may be provided with the present invention, the particular arrangement shown being considered the most convenient.

The spaces 18 and 19 on the face of the record sheet 16 which correspond to spaces 22 and 23 on the plurality of checks 12 are printed in a vertical arrangement as shown in FIG. 1, the spaces 19 being disposed immediately below the spaces 18 so that one of the spaces 19 directly beneath the one of spaces 18 showing the check amount may be conveniently used to compute the account balance resulting from the corresponding checking transaction, while the remaining portion of spaces 19 may be used for automatically recording the purpose of the transaction or some other pertinent information. Each check is vertically offset from its predecessor by an amount approximately equal to the vertical dimension of the spaces 18 and 19 combined, which is equal to the vertical dimension of the spaces 22 and 23 combined, so that the spaces 18 and 19 on the record sheet lie beneath their corresponding spaces 22 and 23 on the checks. This maximizes the number of checks which can be used in the checkbook, given a required vertical dimension for the information spaces and balance spaces, and insures that each consecutive checking transaction will be automatically recorded in the next lower information space on the record sheet. In addition, the record sheet 16 may include a memo portion 24 extending below the spaces 19 corresponding to the lowermost check and providing uncommitted space for writing notes relating to particular transactions or other matters. Since the memo portion is below the information and balance spaces 19 corresponding to the lowermost check, filling in the corresponding information spaces 22 and 23 of the lowermost check will not automatically produce marks in the memo space.

With reference to FIG. 3, a strip of isolated carbon-paper material or other suitable pressure-sensitive duplicating media 28, may be mounted on the back of each check 12 directly behind and limited to the selected spaces 22 and 23 in which the transaction-identifying information is to be written. This will cause the information written in the spaces 22 and 23 to be duplicated in the corresponding spaces 18 and 19 on the inserted underlying record sheet 16 while preventing matter written in other locations on the check 12 from being reproduced on the record sheet. However if a carbon-paper strip is used, and if it is desired to write each check completely before its removal from the checkbook, the record sheet material should be of sufficient thickness to prevent marks outside of the spaces 22 and 23, such as the signature, from being transferred to some of the remaining underlying checks by means of subsequent carbon-paper strips. Accordingly, since the record sheet should be as thick as possible without preventing the checkbook from repeatedly and consistently folding in half, and the checks should be as thin as possible to prevent the checkbook from being too thick due to their large number, the record sheet should be made of a material relatively heavier than the checks. As an alternative to the use of a pressure-sensitive strip such as 28 limited to the selected spaces 22 and 23 only, the information could be reproduced by the use of pressure-sensitive or NCR paper, or by use of a full carbon sheet; however, since the location of the pressure-sensitive media would thus not be limited to the selected spaces 22 and 23, such an alternative would require that the check be removed from the checkbook after the selected spaces 22 and 23 are filled in but before the rest of the check, particularly the signature, is written; otherwise extraneous marks would appear on the record sheet 16 in the spaces reserved for other checks and in the memo space.

Figure 4:
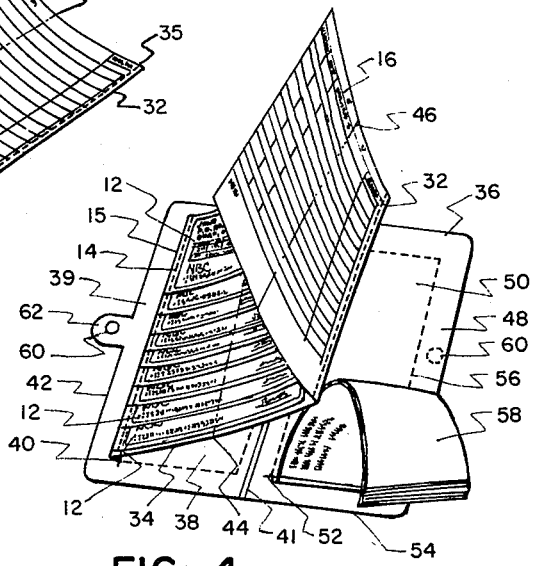
FIG. 4 is a perspective view of the checkbook of the present invention installed in a register-type checkbook cover.

As depicted in the exemplary embodiment, particularly with reference to FIGS. 1, 3 and 4, the vertically-offset overlapping checks 12 are hinged by the principal binding 14 at their left-hand end to a back flap 30, which is substantially thicker and stiffer than the respective checks, so that the checks extend rightwardly across the face of the back flap.

The record sheet 16 is hinged at the right-hand edge of the checkbook to an intermediate flap 34. The intermediate flap 34, which is also thicker and stiffer than the respective checks yet nevertheless bendable, is disposed between the set of checks 12 and the back flap 30 and is permanently bound at its left-hand end to the back flap. Preferably, the back flap 30, intermediate flap 34 and record sheet 16 should be made from a continuous sheet of relatively thick material, folded over at the left-hand edge 15 and the right-hand edge 32 of the checkbook, and perforated along a line 35 adjacent the right-hand edge of the checkbook for removal of the record sheet. The checks are removably bound to the intermediate flap portion of the continuous sheet by glue, staples or some other appropriate method. A pair of holes 37 may be provided in the record sheet for convenience in binding record sheets together after they have been removed from their respective checkbooks. This structure may be easily manufactured and the use of a relatively thick continuous sheet serves the multiple purposes of providing a rigid back flap for insertion into a checkbook cover and a record sheet, supported by a strong intermediate flap, which is sufficiently thick to prevent extraneous marks on underlying checks where carbon backing is used as the reproducing material.

Referring now to FIG. 4, the checkbook is provided with a register-type checkbook cover 36 having two distinct sides 39 and 48 separated by a fold line 41 and a pocket 38 in its left-hand side 39 with an opening 40 adjacent its left-hand outside edge 42 for receiving the back flap 30 of the checkbook. Alternatively other methods of attaching the checkbook to a pocket-sized checkbook cover may be employed, for example clips, in which case the back flap may be deleted from the checkbook. However, the use of the back flap and pocket arrangement is preferred for its simplicity, reliability and ease of manufacture. When the back flap is inserted in the pocket 38, the intermediate flap 34 and checks 12 lay across the cover 36 from left to right and the record sheet 16 lays across the cover, intermediate flap and checks from right to left. It can be seen that the number of checks which may be provided by the checkbook is limited only by the length of the checkbook cover. The length of the checks themselves is approximately the open width of the checkbook cover. Preferably, the relatively thick intermediate flap and record sheet should be provided with creases 44 and 46, respectively, at their centers to facilitate folding of the checkbook and to ensure that the intermediate flap and record sheet fold consistently along one line.

It is significant that the opening 40 in the pocket 38 for receiving the back flap 30 is located adjacent an outside edge 42 of the checkbook cover since this permits a relatively short back flap, substantially no larger in size than one half of the cover, to be utilized in attaching the checkbook to the cover, thereby minimizing the material needed to produce the back flap and, more importantly, leaving the side 48 of the cover opposite the pocket 38 available for holding deposit slips or other useful materials. The side 48 is also provided with a deposit slip pocket 50 formed therein and an opening 52 along a short outside edge 54 thereof for receiving a support flap 56 to which a set of deposit slips 58 is attached. Preferably, the cover 36 should also be provided with a means for holding it securely closed, such as a snap 60 having parts thereof attached to one side of the cover and to an ear 62 connected to the other side.

Thus, the checkbook of the present invention is used by first opening the register-type cover and inserting the record sheet underneath the uppermost check and on top of the remaining checks. The check is written and removed and any additional information which the user desire to keep is written on the memo portion of the record sheet. The balance may be computed at that moment or at a later, more convenient date, immediately below the record of the most recently written check. This process is followed until all of the checks have been exhausted, at which time the record sheet is removed from the intermediate flap and stored in a record book or other permanent file. The checkbook is then removed from the checkbook cover and discarded, and a new checkbook is inserted for further use.

An alternative form of the checkbook, which would be somewhat simpler structurally, is the same as the exemplary embodiment of FIGS. 1–4 with pressure-sensitive strips such as 28 on the backs of the checks, but with the following two differences. First, the checks are stacked in reverse order from that shown, i.e. the first of top check in the vertical arrangement underlies the subsequent checks. Second, no intermediate flap 34 is provided, the record sheet 16 merely being detachably connected to the principal binding 14 underlying the group of checks and covering the back flap 30. The only disadvantage of this alternative arrangement is that it would be necessary to peel back all subsequent checks to uncover the check to be written. The advantage is a somewhat less bulky pocket-sized checkbook otherwise having all of the attributes of the embodiment previously described.

The terms and expressions which have been employed in the foregoing abstract and specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A compact, pocket-sized checkbook assembly adapted for recording a check-writing transaction automatically while a check is being written comprising:

a. a plurality of checks of elongate rectangular shape, having identically positioned spaces on the respective faces thereof designated as spaces for writing information, each said designated space having indicia printed on the face of the respective check indicating the information to be written in said designated space, said checks being detachably connected in a vertically-offset, overlapping relation to one another;

b. a flap underlying said checks having one edge to which said checks are detachably connected, said vertically-offset checks being arranged such that each successive check in a downward sequence partially underlies its predecessor;

c. a record sheet, having a plurality of vertically-arranged spaces on the face of said sheet, detachably connected at one edge thereof to an edge of said flap other than said edge where said checks are connected such that said respective spaces on said record sheet are alignable in underlying relation to the respective designated spaces on the faces of said plurality of checks and such that said record sheet may be selectively inserted between different respective pairs of successive checks and selectively detached from said flap, each said space on the respective faces of said checks which is designated for the writing of information being located below the top edge of the next underlying check;

d. duplicating means associated with said checks for reproducing the images written in said respective designated check spaces on respective ones of said spaces of said record sheet; and e. a register-type pocket-sized checkbook cover of generally rectangular shape foldable along a central line running from the top edge of said cover to an opposite bottom edge thereof so as, when folded, to form a closed cover of elongate shape having its longitudinal dimension extending between top and bottom, connecting means disposed upon said cover and adjacent said one edge of said flap for connecting said plurality of checks to said cover, at least a portion of said connecting means being located adjacent an outside edge of said cover which is parallel to said fold line, said detachable connection of said checks along said one edge of said flap being adjacent said outside edge of said cover such that the longitudinal dimension of each said check crosses said fold line in a direction perpendicular thereto, said checks and record sheet respectively both being folded along said line for compact storage within said cover.

2. The checkbook assembly of claim 1 wherein each said check includes a space on the face thereof designated for writing the amount of the check therein, and said plurality of vertically-arranged spaces on the face of said record sheet includes a plurality of amount-record spaces corresponding respectively to said designated amount spaces on the faces of said checks and being alignable in underlying relation therewith and further including a plurality of balance spaces, on said balance space being disposed below each said amount-record space respectively, each said designated amount space on the respective faces of said checks being located below the bottom edge of any preceding balance space.

3. The checkbook assembly of claim 1 wherein said plurality of checks and record sheet are removably attached within said cover.

* * * * *

UNITED STATES PATENT AND TRADEMARK OFFICE

CERTIFICATE OF CORRECTION

PATENT NO. : 4,014,566

DATED : March 29, 1977

INVENTOR(S) : Bob I. and Sally H. Cantrell

It is certified that error appears in the above-identified patent and that said Letters Patent are hereby corrected as shown below:

| | | |
|---|---|---|
| Col. 1 | line 20 | Change "to" to --into. |
| Col. 2 | line 39 | Change "identifying" to --identify--. |
| Col. 6 | line 56 | Change "desire" to --desires--. |
| Col. 7 | line 5 | Change "of" to --or--. |
| Col. 8 | line 39 | Change "on" to --one--. |

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*